United States Patent [19]

Reil

[11] Patent Number: 4,548,110

[45] Date of Patent: Oct. 22, 1985

[54] CUTTING DEVICE FOR A FLEXIBLE WEB

[75] Inventor: Wilhelm Reil, Bensheim, Fed. Rep. of Germany

[73] Assignee: Tetra Pak Developpement S.A., Switzerland

[21] Appl. No.: 708,307

[22] Filed: Mar. 5, 1985

Related U.S. Application Data

[63] Continuation-in-part of Ser. No. 529,310, Sep. 6, 1983, abandoned.

[30] Foreign Application Priority Data

Sep. 7, 1982 [DE] Fed. Rep. of Germany ..... 3233097

[51] Int. Cl.[4] ..... B26D 3/16

[52] U.S. Cl. ..... 83/176; 83/33; 83/368; 83/559

[58] Field of Search ..... 83/368, 33, 176, 559

[56] References Cited

U.S. PATENT DOCUMENTS

| | | | |
|---|---|---|---|
| 4,046,039 | 9/1977 | Griesbach | 83/368 |
| 4,214,492 | 7/1980 | Hoffman | 83/368 |
| 4,375,175 | 3/1983 | Elsas et al. | 83/368 |

*Primary Examiner*—Donald R. Schran

*Attorney, Agent, or Firm*—Biebel, French & Nauman

[57] ABSTRACT

In apparatus for cutting a web of flexible material, upper and lower cutters are mounted on a swivel arm movable by a control means which determines the position of the cut. The control means includes a pneumatic cylinder and piston pivoted to a control arm linked to or integral with the swivel arm and of a much shorter effective length than the swivel arm. The cutting action is initiated by inter-engagement between the swivel arm and a stop edge of the web.

8 Claims, 16 Drawing Figures

CUTTING DEVICE FOR A FLEXIBLE WEB

CROSS-REFERENCE TO RELATED APPLICATION

This application is a continuation-in-part of U.S. application Ser. No. 529,310, filed Sept. 6, 1983.

BACKGROUND OF THE INVENTION

The invention relates to an apparatus for exactly positioning a cut in a web of flexible material, comprising a lower cutter and an upper cutter hinged rotatably thereto, at least one of the cutters being driven, and comprising a means for advancing the web of material.

The manufacture of individual articles, lengths of strip or packs from a wide variety of materials, which all have the physical property of a flexible material and a certain inherent stiffness, universally plays a big part in industry. Cuts often have to be made at certain positions in an intermittently conveyed web of flexible material. Such webs of flexible material with a certain inherent stiffness may be made, e.g., of plastics, rubber, thin wood, paper or paper board. With webs of this type, cheap mass-produced goods can be made in large numbers per unit of time, merely to take packs as an example.

There is a particular problem in the field of liquid packs, in the production of which it is known to form a smaller or larger tube from the flat web unwound from a supply roll, the tube being filled and severed or first severed and then filled. If the web of material still has no incision anywhere along the conveying direction, that is to say, if a clean cut merely has to be made to separate one piece of web from another, the problem of accurate incision does not necessarily arise in such a critical way, as compared with cases when the piece of web to be processed already has grooves, folds, cuts or perforations which always have to be kept an exact distance from the cut which is to be made. Webs of flexible material have tolerances resulting from fluctuations due to the physical property of the material, e.g., fluctuations in thickness, temperature, composition and the like. It is extremely expensive to detect the given cuts, grooves, folds in the web or the like by electrical or optical measures, then to arrange for a highly complex control means to make the cutter or cutters make the incision exactly in the desired position.

SUMMARY OF THE INVENTION

One object of the present invention is to provide an apparatus for exact positioning of a cut in a web of the type described above, whereby an accurate cutting position can be achieved and maintained with simple means.

According to the invention the problem is solved, in that both the upper cutter and the lower cutter are arranged on a swivel arm which can be moved by a control means, and that the control means interacts with the web of material to be cut, in such a way that the cutting position is detected by the control means and translated into a movement of the swivel arm. Thus, the web of material itself has the properties whereby the control means immediately recognizes the place to make the desired cut. When the control means has detected the desired cutting position, then the cutting device which is arranged on a movable swivel arm, is brought by it to the desired cutting location.

It is particularly advantageous if the control means includes a pneumatic cylinder with a movable piston hinged to one end of a control arm, if the end of the swivel arm is hinged to the other end of the control arm, while at least one cutter is mounted at the other end of the swivel arm, and if the lever of the control arm is substantially smaller than that of the swivel arm. A solenoid, an electric control means or a hydraulic cylinder may obviously be used instead of the pneumatic cylinder, although in practice a pneumatic cylinder has been found to be strong, simple and reliable to use.

The swivel arm is thus connected to the pneumatic cylinder by a control arm, with a lever ratio such that the swivel arm with the cutters mounted on it is substantially longer than the control arm. In this way, the force of the pneumatic cylinder, which finally acts on the cutters, can be kept weak without adversely affecting the speed at which the swivel arm moves and its accurate control. This weak force ultimately acting in the cutters in fact has the advantage that, in the interaction between the web of material to be cut and the control means via the swivel arm, the swivel arm to be controlled can itself be used as the sensing device, since a web of material to be cut, even one made of thin material, does not undergo any impairment, deformation, indentation or upsetting. Thus the pneumatic cylinder need only receive a simple preliminary control, which it passes to the swivel arm while simultaneously receiving control signals therefrom.

In a particularly desirable embodiment of the invention, for interaction between the web of material and the control means, a stop for contact with the swivel arm is provided on the web of material; this can be moved away from the stop before cutting and moved onto the stop by the control means. The stop on the web of material can be formed in many different ways. In a continuously or intermittently working machine there are a great variety of actions and treatments or modifications of the web of material. In an intermittently operating machine, for example, an incision can be made in the web, and the material can be at least partly raised before or after the incision in the conveying direction of the web so that this in itself provides a stop. With a web of material thus marked, the control means can thus pick up signals from the mark via the swivel arm by the measures according to the invention, and arrange the measures to be taken accordingly. In accordance with the invention, it is preferable for the swivel arm to be moved before the action provided by the invention, i.e., before the exact application of the cut, both in the movement away from the stop and also—preferably when the direction of movement has been reversed—in the swivelling onto the stop. For example, if the upper cutter, the lower cutter or both cutters come into engagement with the stop on the web of material, then the swivel arm is immobilized, either by the stop on the web or by a control command in the control means; the cutter can then come into action immediately and make the desired cut exactly at the desired location.

In accordance with the invention, it is desirable for the stop on the web of material to be formed by at least one incision in the web and by folding it along at least one grooved line extending in the direction in which the web is conveyed. Specifically, if a tube for making liquid packs is to be formed, the entire tube, corresponding to the length of the web of material, must ultimately be divided or separated to form individual packs. In the manufacture of the liquid pack, it may be desirable to cut part way into the tube and then to form the stop in the region of the incision, by folding in the material in front of or behind the incision—as seen in the direction in which the web is conveyed. If accurate folding in or folding in at specific predetermined positions in the web is desired, then grooved lines have to be made in the web previously in known manner. Since a stop for the swivel arm according to the invention must have an edge transverse to the conveying direction of the web of material, folding in should also take place transversely to that direction, that is to say, about a grooved line in the conveying direction of the web.

For the above-mentioned reasons, the apparatus according to the invention can be used particularly advantageously to separate partly incised but attached pieces of tubing made from a coated paper web. A tube of any type has a circular cross-section in the finished state. The stop in the web of material can be obtained in a particularly simple and advantageous manner when making partial incisions in such a tube, by arranging the grooved lines extending along the generated lines of the tube not exactly on diametrically opposed sides. If a plane is thought of as extending through the grooved lines of such a tube, then according to the teaching of the invention, this plane should not extend exactly through the center line (of the center of the circle) but should be somewhat eccentric thereof. In this way it becomes possible, when the tube is partly pressed together transversely of its longitudinal axis, for one web to come closer to the shape of a plane than the other, because as seen in cross-section the portions are not halves of equal length but fractions of different lengths. One fraction, e.g., the longer one as seen in cross-section, is preferably cut, and the short fraction, possibly already lying in a plane, is not. Then these pieces of tubing are joined together along the flat part and incised along the longer fraction which curves partially upwards. To separate them, the last cut must then take place exactly under the existing incisions. To achieve this, the apparatus of the present invention provides so to speak a "seeking cutter," because the cutter portions mounted on the swivel arm seek for themselves the stop and thus the position at which the final severing is to take place to separate or individualize the pieces of tubing.

It will be appreciated from the above, by what simple means an apparatus is provided for very accurate and precise positioning of a cut at a desired location in a web of material.

Further advantages, features and applications of the invention will emerge from the following description, in conjunction with preferred examples.

DETAILED DESCRIPTION

Figure 1:
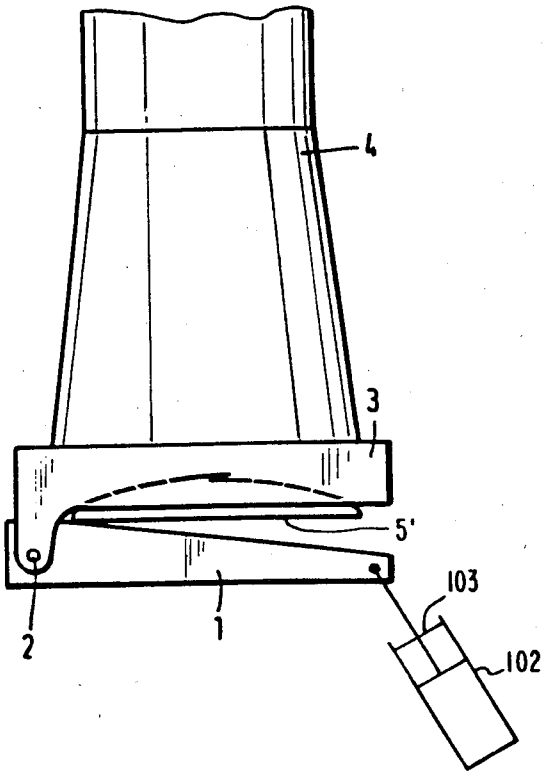
FIG. 1 is a diagrammatic cross-section of a web of material and the cutting apparatus, with its holding device shown broken off.

The lower cutter 1 and the upper cutter 3, which is pivotally hinged thereto by means of the hinge pin 2 and which is fixed to a swivel arm 4, are shown diagrammatically in FIG. 1. The diagrammatic cross-section of a web shaped into a large or small tube can be seen between them, with thick lines.

Figure 2:
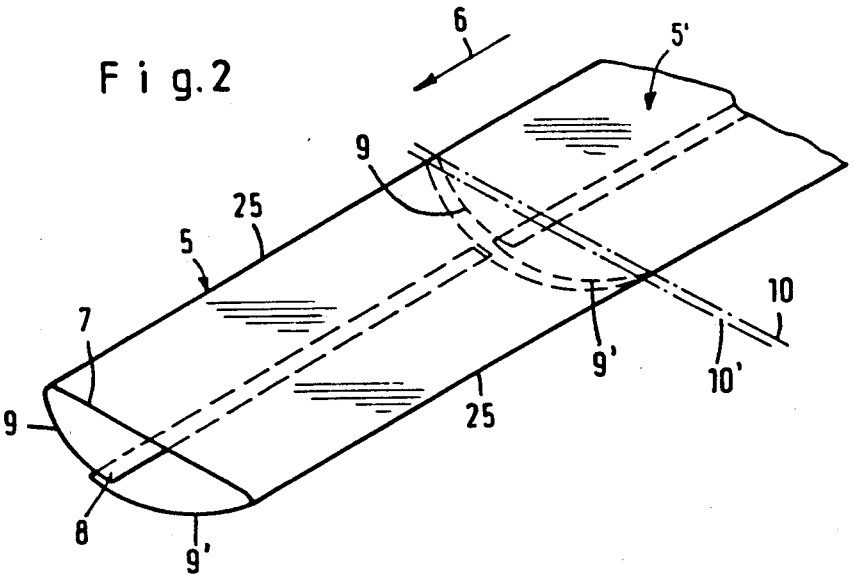
FIG. 2 is a perspective view of a broken off part of the web of material, looking at it from below.
Figure 3:
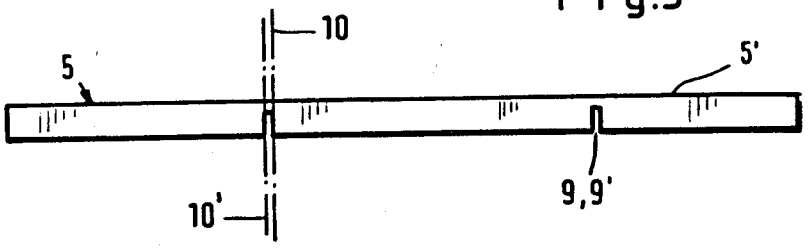
FIG. 3 is a side view of the web of material, looking at it, e.g., from front right to top left in FIG. 2.

The web can be seen more clearly in a perspective view in FIG. 2 and in side elevation in FIG. 3. As a simpler explanation of the invention, the web is upside down in FIGS. 2 and 3, i.e., the flat side which is at the bottom in cross-section in FIG. 1, is at the top in FIGS. 2 and 3. The web of material is shown generally at 5 and taken to move in the direction of the arrow 6. It is made of flexible material, in the embodiment illustrated a relatively thick paper coated with plastics on both sides, such as is used, e.g., for making liquid packs. A cut 7 has to be made in this coated paper, the cut extending from one longitudinal edge of the flat side of the web to the other. The overlap 8 can be seen from the side which is opposite in the cross-sectional view in FIG. 2; this is where the web of material was shaped and welded into a tube, before being laid flat to form the flat portion. The cut edges or incisions 9, 9' will be recognized, extending from the side edges just described, which lie along grooved lines 25 (FIG. 4), down to the overlap 8 in FIG. 2. At the right end of the first left-hand piece of tube in FIG. 2, these incisions 9 and 9' will be seen again, shown in broken lines because the cuts lie below the flat surface of the web 5 facing the viewer. Two dash and dot lines 10, 10' run transversely to the conveying direction 6 of the material 5 in FIGS. 2 and 3. The distance between these two lines represents the tolerance range for positioning the cut in the web 5. For normal milk or fruit juice packs, this will be a length of, e.g., 3 mm. The incision 7 must finally be made within this region between the two lines 10 and 10'. It must exactly adjoin the two incisions 9, 9', so that the individual pieces of tube are separated from the main web 5 at one and the same cutting point.

Figure 4:
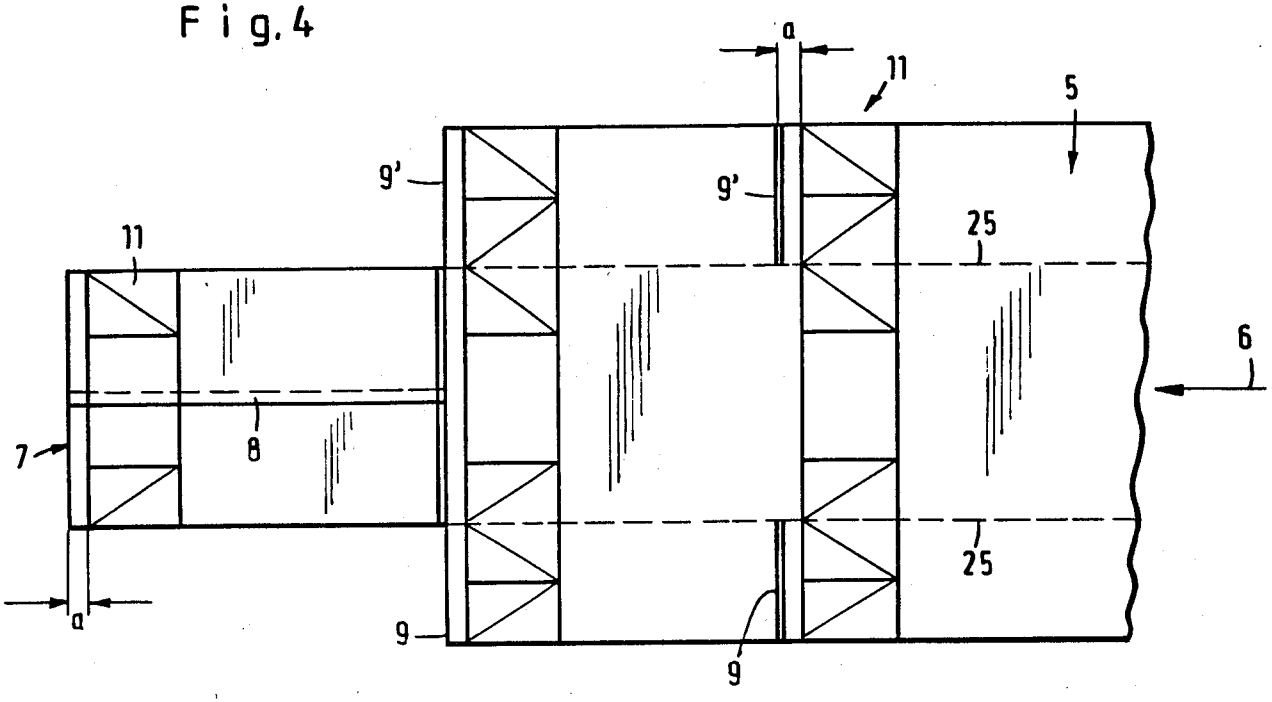
FIG. 4 is a plan view of the blank of material before it is folded into the tube in FIG. 2, FIGS. 5*a* and 5*b* are diagrammatic cross-sectional views of a tubular web, respectively in the pressed-together and non-folded state.

FIG. 4 is a plan view of a flat web of platic-coated paper, i.e., flexible material, and the direction of conveying is again shown by the arrow 6. The web shown in FIG. 4 is divided into three portions, from which three pieces of tube will subsequently be formed after the last cut, and finally three packs. From the right-hand third of the web, one can see stamping, extending over the whole width and shown generally at 11, with the aid of which a bottom or top of the pack can later be shaped. Two parallel grooved lines 25 can be seen transversely to the stamped strip 11, i.e., the conveying direction 6 of the web 5.

A distance a to the left of the stamped section 11 two incisions 9, 9' extend transversely to the conveying direction 6 and run from the outer edge to the appropriate grooved line 25. Parallel with the stamped section 11 the region to the right of the incisions 12, with a width a, later provides a transverse seam to seal the pack.

When the center third of the web in FIG. 4 is moved to the left by further advance in the direction 6, the web 5 is folded in along the grooved lines 25, upwards towards the viewer; the section at the bottom in FIG. 4 is turned in or folded upwards first, and then the top section. The arrangement shown in the left-hand third of FIG. 4 is then obtained, and the overlap 8 can be seen again. As a result of the incisions 9 and 9', the width of the web 5 has been reduced by the width of the lateral sections.

When the web 5 then moves further to the left in the conveying direction 6, the above-mentioned cut 7 must then be made along the line shown by the arrow 7 at the left-hand side of FIG. 4; this is exactly in line with the incisions 9 and 9'.

In order that the swivel arm 4 of the control means can interact with the web of material 5, so that the cut 7 is exactly in line with the incisions 9, 9', a stop 12 is formed by the web material itself. This stop 12 can be seen mostly clearly from FIG. 7. It is formed by holding down the left-hand part of the tube in FIG. 7 by rollers 16 and cutter 3 and releasing the part of the tube to the right of the upper cutter 3 or letting it spring up.

Figure 5A:
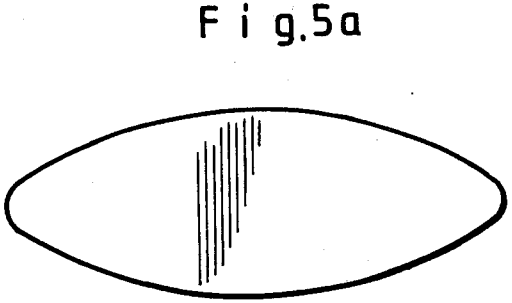
Figure 5B:
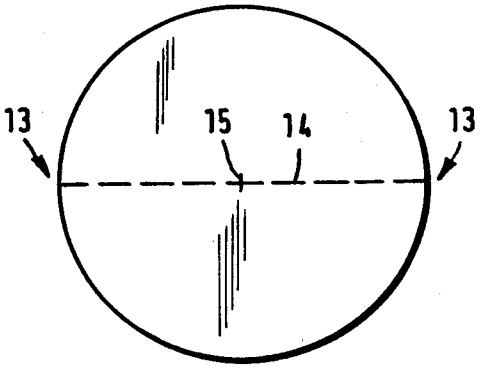

Formation of the tube cross-section shown in FIGS. 1 and 2 will first be explained with reference to FIGS. 5 and 6. In FIGS. 5*b* and 6*b*, the cross-section of the tube is shown as a circle. At the places indicated by the arrows 13, there are the grooved lines 25; these extend transversely to the plane of the paper and are, therefore, virtually not visible in FIGS. 5 and 6. If an imaginary plane is formed through the grooved lines, then the plane 14 is obtained, which is imaginary in FIGS. 5*b* and 6*b* and indicated by a broken line. In order to lay flat an initially round tube, it will be appreciated that an expert would arrange the grooved lines 25 on diametrically opposed sides, with the imaginary plane 14 running through the central longitudinal axis 15. But this would have the disadvantage that, when the tube or piece of tubing is laid flat in the FIG. 5*a* state, two sides of equal length would be formed, and when they had been laid flat, there would be no difference in paper tension or elasticity between them.

Figure 6A:
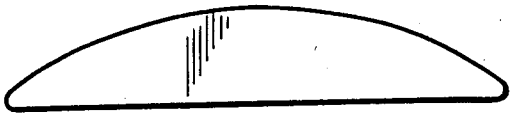
FIGS. 6*a* and 6*b* show the same thing as FIGS. 5*a* and 5*b*, but with the grooved lines at a different location in the web.
Figure 6B:
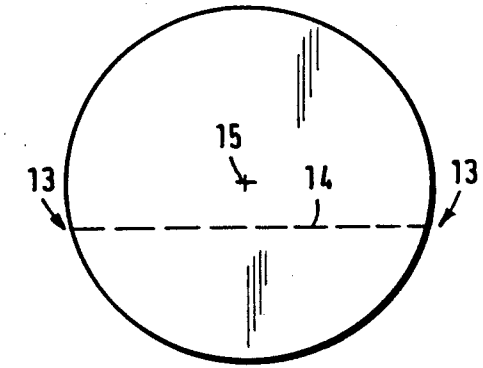

However, if the grooved lines 25 are arranged in the position shown by the arrow 13 in FIG. 6*b*, eccentrically to the center of the tube so that the imaginary plane 14 does not run through the central longitudinal axis 15 of the tube, then laying flat results in the state shown in FIG. 6*a*, with a shorter portion at the bottom and a longer, i.e., curved one at the top. When such a tube, shown diagrammatically in cross-section in FIG. 6*a*, is compressed, the larger upper surface always tends to curve upwards into the position shown in FIG. 6*a*.

Figure 7:
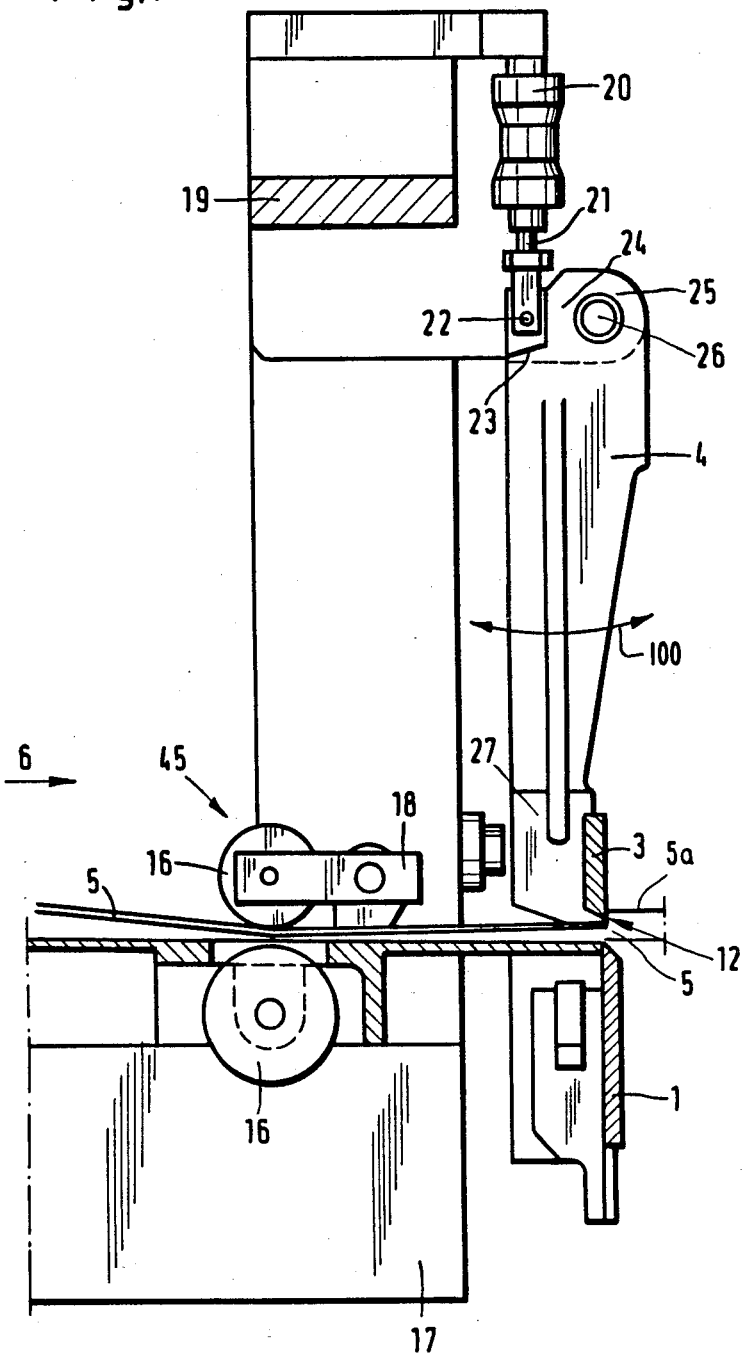
FIG. 7 is a side view of the cutting apparatus, in a preferred embodiment with a pneumatic cylinder.

If, as explained above, the incisions 9 and 9' (see FIG. 2) have been provided in the upper curved portion of the tube in the FIG. 6*a* state, and if the piece of tube facing towards the viewer of FIG. 6*a*, which can be thought of as being above the plane of the paper and thus above the incisions 9 and 9', is held together flat, while the other piece of tube extending back from the plane of the paper is left in its unloaded state, then the viewer must find the FIG. 6*a* state, i.e., with the incisions 9, 9' lying in the longer curved top portion, which thus forms the stop 12 shown in FIG. 7.

In FIG. 7, the web of material 5, driven by drive rollers 16, moves to the right into the cutting apparatus in the conveying direction of the arrow 6, i.e., from left to right in the drawing. The left-hand part of the tube has previously been provided with incisions 9 and 9' and is held down by the advancing roller 16, i.e., is pressed flat, as will be seen from the placement of engagement with the two rollers 16. The beam 17 carries not only the support 18 for the advancing rollers 16 but also the support 19 for pneumatic cylinder 20 with piston 21. The piston 21 is coupled to the left end 23 of a control arm 24 at the point 22, while the arm 24 is pivotable about hinge pin 26 at its right end 25. Contraction of piston 21 causes swivel arm 4 to pivot backwards (left) about pin 26 and extension of piston 21 pivots arm 4 forwards (right) as shown by the arrow 100. Those skilled in the art will appreciate that the angle through which arm 4 pivots is only a few degrees, this small angle being sufficient to align the cut 7 in the web and not interfering with the conveyance of the web.

The arm 4 is shown hanging down in a cutting position in FIG. 7, and it is connected at its lower end 27 to the upper cutter 3 and via the coupling point 2 (FIG. 1) to the lower cutter 1. The swivel arm 4 and control arm 24 consist of one rigid piece. It will be seen from FIG. 7 and in more detail in FIG. 11 how the right-hand edge of the upper cutter 3 is brought into contact with the stop 12 on the trailing edge of the released portion 5*a* of the web. In this state the cut 7 can be made in the flat surface of the web of material 5, by actuating cutter drive means such as a hydraulic or pneumatic cylinder 102 with piston 103 coupled directly or indirectly to cutter 1 as shown in FIG. 1. Cut 7 will be exactly in alignment with the incisions 9, 9'.

Figure 8:
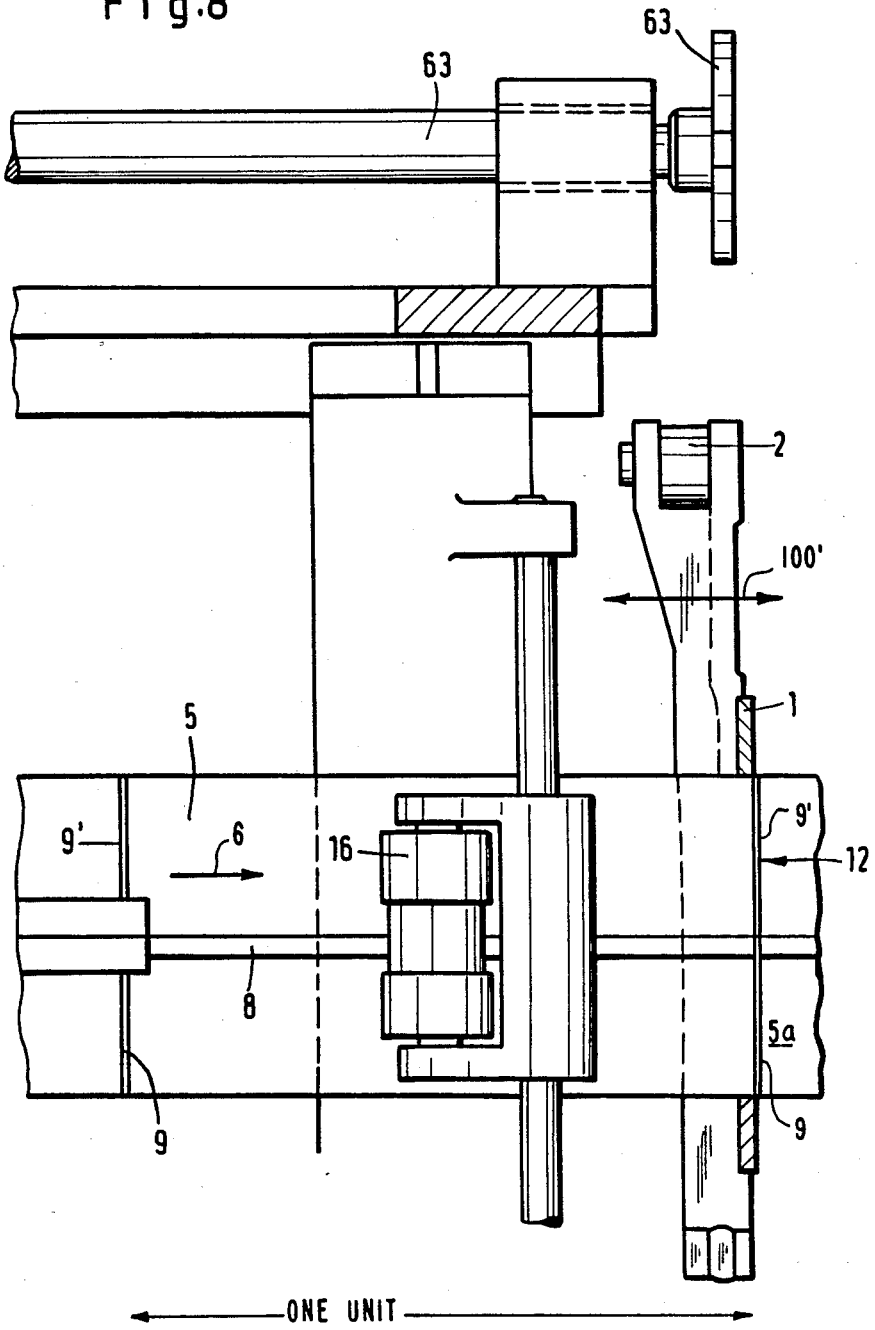
FIG. 8 is a plan view of the cutters with the holding means and the web of material.

FIG. 8 is a plan view of the part of the cutting apparatus shown in FIG. 7; here the upper advancing roller 16 and the web of material 5 with the overlap 8 and incisions 9, 9' can be seen. The upper cutter 3 and swivel arm 4 have been omitted to simplify the drawing, so that only the lower cutter 1 and its coupling point for the upper cutter will be recognized. The length of tubing to the right of the stop 12 curves upwards, so that it has the cross-section shown at the left-hand side in FIG. 2 or FIG. 6*a*, while to the left of it, the length of tubing is still relatively compressed below the rollers 16.

Figure 14:
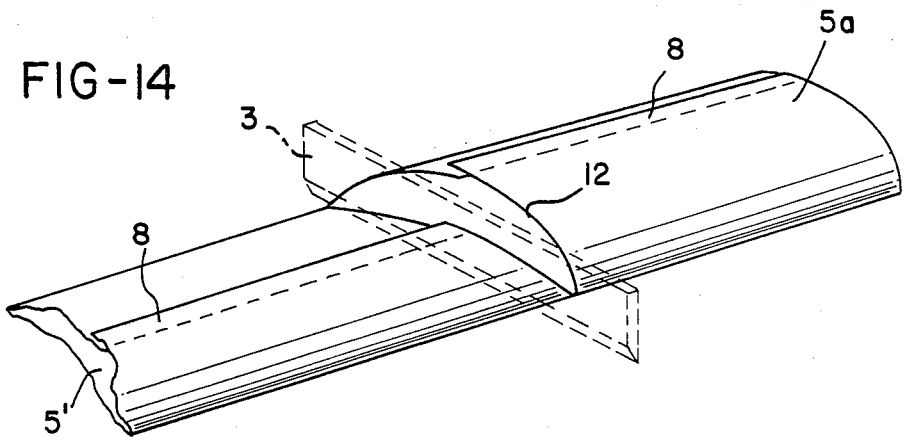
FIGS. 10–14 illustrate specific events in the operation of the cutting apparatus of the present invention.
Figure 10:
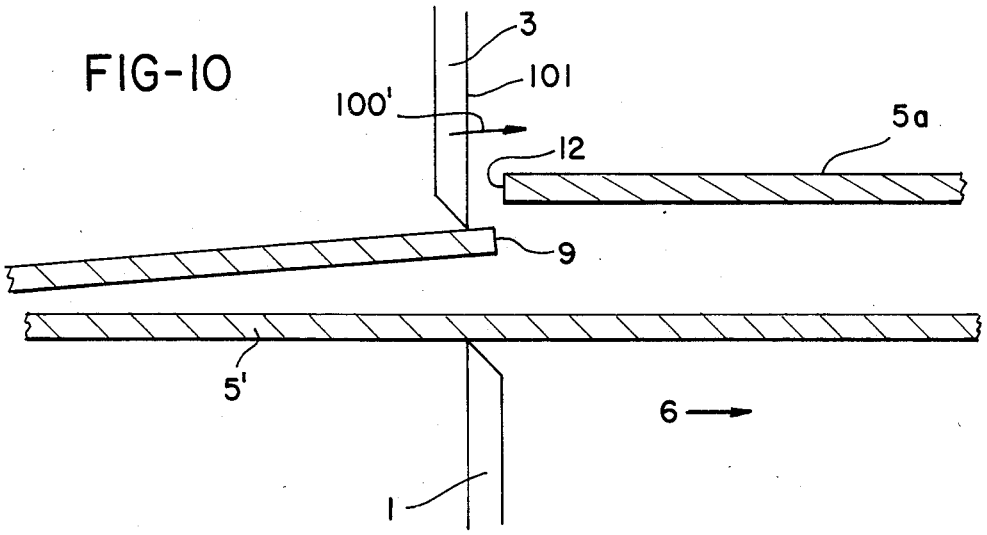

In operation, the cutting apparatus works as follows: while the web of material is advancing in the conveying direction 6, the swivel arm 4 is swung to the left about the hinge pin 26 from the position shown in FIG. 7, and immediately swings back to the right, i.e., counterclockwise in FIG. 7, after a change of direction controlled by the pneumatic cylinder 20 (arrow 100). It swings back at a speed higher than the conveying speed of the material 5. In this way, the upper cutter 3 on the swivel arm 4 can then strike the material containing the incisions 9, 9', i.e., stop 12, the material being stopped in the FIG. 7 position by control means (not shown). The position of the web 5 and the cutter 3 abutting the stop 12 is also shown in FIG. 14 where the cutter 3 is shown in dotted line.

Owing to the ratio of the short lever of the control arm 24 at the top to the long lever of the swivel arm 4, the power of the pneumatic cylinder is so weak that, when the upper cutter 3 strikes against the stop 12, the later does not suffer any damage. The weak force acting in the upper cutter 3 stops the swivel arm 4 in the FIG. 7 position. This triggers a control signal which actuates the cutter 1 and the incision 7 is made.

Figure 9:
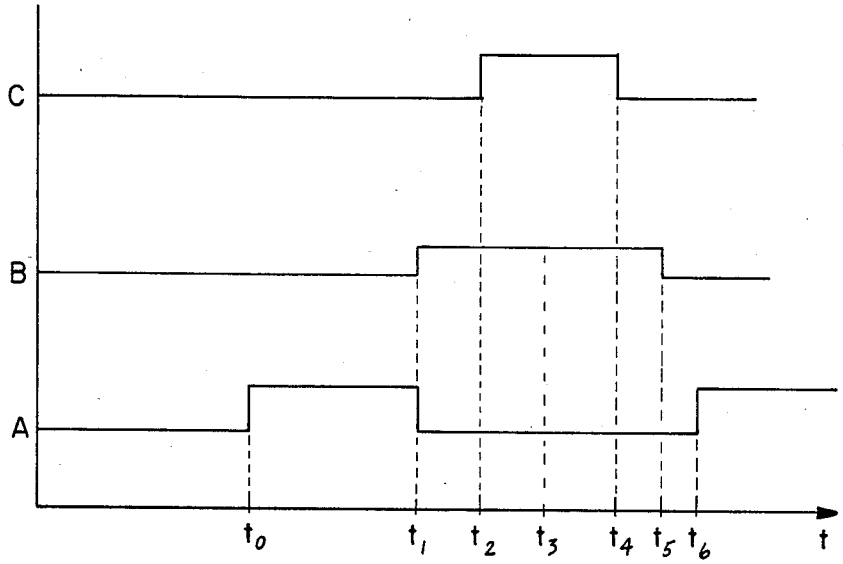
FIG. 9 is a time diagram illustrating the operation of the cutting apparatus of the present invention.

The operation of the cutting apparatus is also illustrated by reference to FIG. 9, which is a time diagram showing the manner in which the movement of the web (line A), the pivot of the swivel arm (line B), and the actuation of the cutter (line C) are coordinated in one embodiment of the invention. In the time diagram, pulses actuating the web, swivel arm or cutters are represented by an elevation in the respective time lines A, B and C.

Beginning at time $t_0$ and continuing until time $t_1$, the web is advanced one unit (FIG. 8) such that the incisions 9 and 9' are positioned over the cutting station. At time $t_1$, the cutters and the web are in the position shown in FIG. 10, with swivel arm 4 and the cutters 1 and 3 pivoted slightly left of the desired location of the cut 7 which is to be in alignment with the incision 9 and 9'. When incisions 9 and 9' pass beyond the cutter 3, the portion of the web downstream of cutter 3 is released. The web expands (opens) and thereby creates the stop 12 as the trailing edge of the upper portion 5*a* of the open web. In FIGS. 10–13, the observer is looking across the web, down (along) the cut 9. The cut 9' is not seen from this view.

Figure 11:
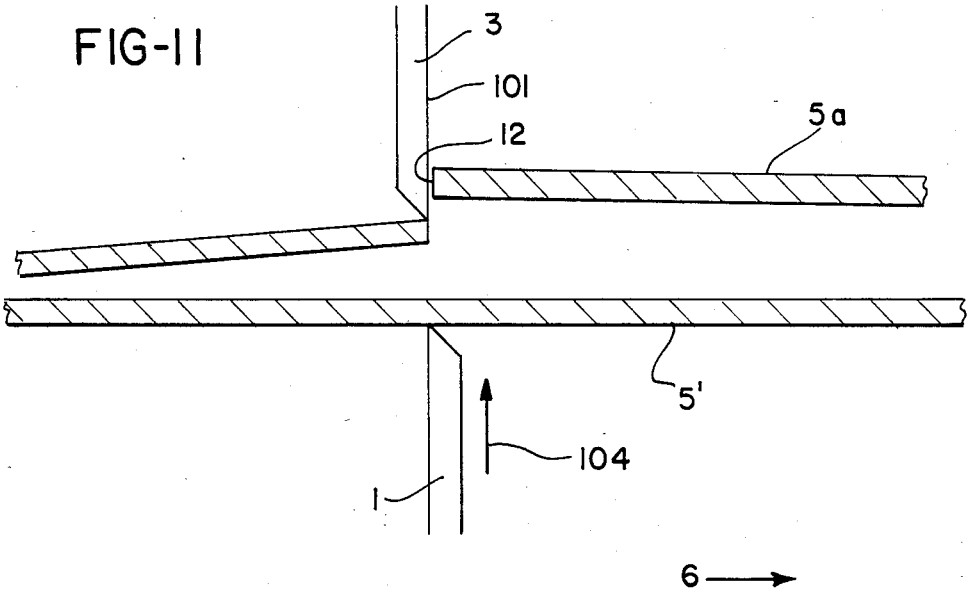

At time $t_1$, the swivel arm is actuated. The swivel arm carrying knives 1 and 3 pivots forward as shown by the arrow 100' in FIG. 10 until the front face 101 of cutter 3 contacts stop 12 as shown in FIG. 11. The time of contact is defined a $t_2$.

When cutter 3 contacts stop 12, the signal to the pivot arm may be discontinued or the signal may continue. In the embodiment shown in FIG. 9, from time $t_2$ to time $t_5$, the swivel arm 4 continues to urge the cutters forward such that upper cutter 3 is maintained in abutment with the stop 12. One of the important features of the present invention is that face 101 of cutter 3 maintains contact with stop 12 and alignment with incisions 9 and 9' without damaging the web.

Figure 12:
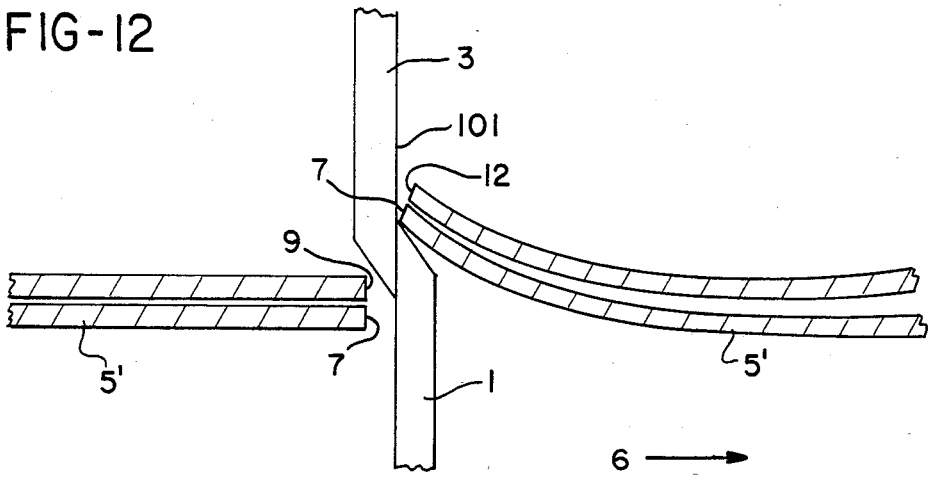
Figure 13:
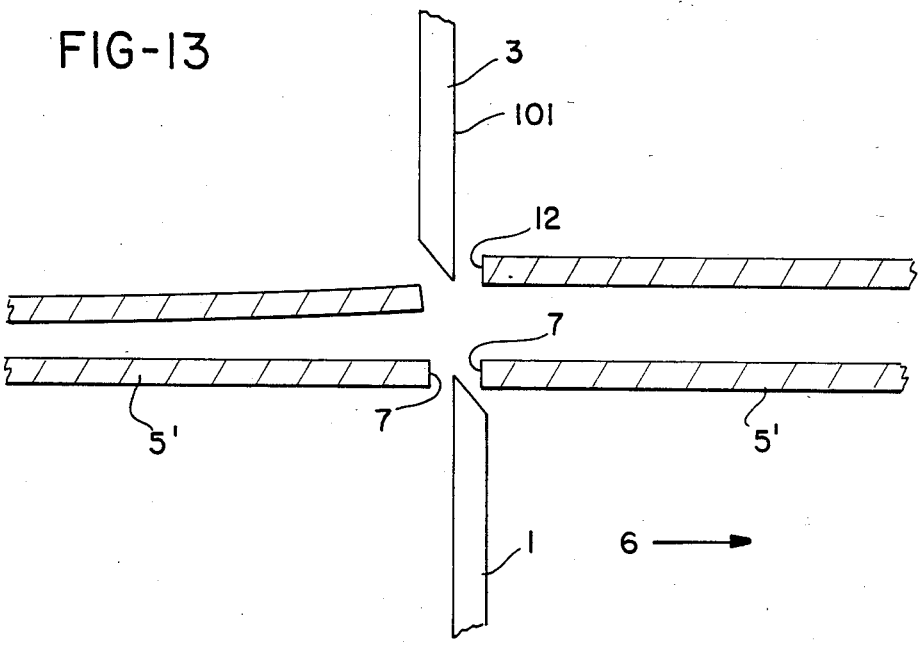

At $t_2$, cutter 1 is actuated, e.g., hydraulic means 102 and 103 move the lower cutter 1 upward causing a scissoring action with cutter 3, and at time $t_3$ a cut 7 is made in the web 5 as shown in FIG. 12. Thereafter, the cutter 1 is lowered by the mechanism 102, 103 and at time $t_4$ the pulse to the cutters discontinues and the web and the cutters are in the position shown in FIG. 13.

After cutter 1 is lowered, the swivel arm 4 is immediately pivoted to the left. At time $t_5$, the swivel arm 4 is stopped slightly left of the cutting position and the cycle is started again at $t_6$.

Having described the invention in detail and by reference to preferred embodiments thereof, it will be apparent that modifications and variations are possible without departing from the scope of the invention defined in the appended claims.

What is claimed is:

1. Apparatus for positioning a cut in a web of flexible material, said web having a pair of side edges joined together to from a tube having a central axis and at least one diameter, said web further defining at least one series of spaced incisions extending inwardly from one of said edges across said web, said apparatus comprising:

a frame;

means for moving said web along a path in the direction of said axis;

means mounted to said frame and positioned along said path for compressing said tube to less than said diameter as said web moves therepast and subsequently releasing said web;

an arm pivotally mounted to a first point to said frame for arcuate movement along a pivot path having one tangent thereto which is parallel to said central axis of said tube;

means for pivotally moving said arm about said pivot point;

said arm defining a flat surface disposed perpendicularly to said pivot path;

cutting means carried on said arm for cutting said web;

means for pivotally moving said arm away from said web in direction reverse to the direction of movement of said web, moving said arm in the direction of movement of said web until said surface contacts a stop defined by a released portion of said web at one of said incisions; and means for operating said cutting means.

2. Apparatus as defined in claim 1, wherein said web includes at least one bending line defined therein parallel to said tube axis, said compressing means folding said web along said bending line to compress said tube.

3. Apparatus as defined in claim 2, wherein said web includes two bending lines defined therein and mutually parallel, said bending lines being disposed on said tube in a non-diametrically opposed relationship.

4. Apparatus as defined in claim 3, wherein said web includes a series of pairs of spaced incisions, a first of said incisions of each of said pairs extending from one of said side edges to one of said bending lines, and a second incision of said pair extending colinear with said first incision from an opposite side edge to the other of said bending lines, said first and second incisions defining said stop.

5. Apparatus as defined in claim 1 wherein said web moving means includes a pair of rotatable cylinders carried on said frame, and means for rotating said cylinders, whereby said web is moved therebetween, and wherein said tube compressing means includes said cylinders.

6. Apparatus as defined in claim 1 wherein said arm is mounted to said frame such that said pivot path lies within a vertical plane.

7. Apparatus as defined in claim 1 wherein said pivotal moving means includes a pneumatic cylinder connected between said frame and said arm.

8. Apparatus for positioning a cut in a web of flexible material comprising:

an arm pivotally mounted for arcuate movement along a pivot path having one tangent thereto which is parallel to the traveling direction of said web;

means for pivotally moving said arm about said pivot point;

said arm carrying a flat surface disposed perpendicularly to said pivot path;

cutting means carried on said arm for cutting said web;

means for moving a web along a path in a traveling direction, said web having a series of inwardly extending spaced incisions therein;

means for pivotally moving said arm in a direction opposite said traveling direction, reversing direction and pivotally moving said arm in said traveling direction until said flat surface contacts said incision; and means operating said cutting means such that a cut is provided in said web in alignment with said incisions.

* * * * *